US008221161B2

(12) United States Patent
Leibfried, Jr.

(10) Patent No.: US 8,221,161 B2
(45) Date of Patent: Jul. 17, 2012

(54) BREAK-AWAY ADAPTER

(75) Inventor: Richard Glenn Leibfried, Jr., Mechanicsburg, PA (US)

(73) Assignee: Souriau USA, Inc., York, PA (US)

( * ) Notice: Subject to any disclaimer, the term of this patent is extended or adjusted under 35 U.S.C. 154(b) by 0 days.

(21) Appl. No.: 12/861,359

(22) Filed: Aug. 23, 2010

(65) Prior Publication Data

US 2011/0053395 A1 Mar. 3, 2011

Related U.S. Application Data

(60) Provisional application No. 61/237,935, filed on Aug. 28, 2009.

(51) Int. Cl.
*H01R 9/05* (2006.01)

(52) U.S. Cl. ..... 439/578; 439/253; 439/638

(58) Field of Classification Search ..... 439/578, 439/638, 253–257, 300, 675, 642
See application file for complete search history.

(56) References Cited

U.S. PATENT DOCUMENTS

| | | | | |
|---|---|---|---|---|
| 4,138,181 | A | 2/1979 | Hacker et al. | |
| 4,206,963 | A * | 6/1980 | English et al. | 439/581 |
| 4,372,624 | A | 2/1983 | Neilson | |
| 4,544,224 | A | 10/1985 | Goodman et al. | |
| 4,545,633 | A | 10/1985 | McGeary | |
| 4,687,279 | A * | 8/1987 | Holland et al. | 439/578 |
| 4,846,731 | A * | 7/1989 | Alwine | 439/651 |
| 4,941,846 | A * | 7/1990 | Guimond et al. | 439/578 |
| 5,062,808 | A * | 11/1991 | Hosler, Sr. | 439/580 |
| 5,199,893 | A | 4/1993 | Fussell | |
| 5,217,391 | A * | 6/1993 | Fisher, Jr. | 439/578 |
| 5,388,874 | A | 2/1995 | Barrier | |
| 6,024,609 | A * | 2/2000 | Kooiman et al. | 439/675 |
| 6,619,876 | B2 | 9/2003 | Vaitkus et al. | |
| 6,692,285 | B2 | 2/2004 | Islam | |
| 6,769,926 | B1 * | 8/2004 | Montena | 439/253 |
| 6,848,931 | B2 | 2/2005 | McMullen et al. | |
| 7,189,113 | B2 * | 3/2007 | Sattele et al. | 439/578 |
| 7,347,726 | B2 * | 3/2008 | Wlos | 439/578 |
| 2007/0270012 | A1 | 11/2007 | Showcatally et al. | |

* cited by examiner

*Primary Examiner* — Hae Moon Hyeon

(57) ABSTRACT

The invention is directed to an adapter for use with a connector assembly. The adapter has a receptacle body and a locking sleeve. The receptacle body is applied to a first portion of the connector assembly, and the locking sleeve is applied to a second portion of the connector assembly. The locking sleeve can be easily disengaged from the receptacle body to remove the second portion or the connector assembly from the first portion.

20 Claims, 4 Drawing Sheets

BREAK-AWAY ADAPTER

FIELD OF THE INVENTION

The present invention is directed to an adapter for use with a coaxial connector. The adapter allows the male portion of the connector to be disengaged when a pre-determined force is applied thereto. The adapter is used to convert a standard threaded coupled connector into a push-on and break-away connector.

BACKGROUND OF THE INVENTION

Coaxial connectors for radio frequency (rf) signals are known. Such connectors are typically used with a coaxial cable containing an external conductor/shield surrounding one or more internal conductors. The coaxial connector functions to align and provide an electrical path to the respective ends of the conductors while providing a continuous shield to minimize rf leakage. These connectors generally include a female portion and a male portion. The male portion contains the conductor interface and a threaded nut used to engage the female portion.

The female portion includes a tubular housing that functions to accept the conductor interface of the male portion and align the conductor interface with a mating rf conductor held within the female portion. The tubular housing of the female portion is provided with an external thread to accept the threaded nut of the male portion.

The tightening of the threaded nut of the male portion onto the external thread of the female portion functions to bring the rf conductors into physical contact, thereby reducing electrical resistance and rf leakage.

While existing connectors work relatively well, they are time-consuming to install. To connect or disconnect conductors, the threaded nut must be engaged or disengaged before the connection may be made or broken. Further, once reconnection is required, the threaded nut must be retightened. In addition, temperature cycling and/or rotational torque applied to the cable assembly can cause the threaded nut to back off, negatively impacting electrical and mechanical performance. Also, the existing connectors do not allow the male portion to be disengaged or break away from the female connector if a harmful force is applied to either connector, thereby creating the possibility that the connector portions or the system will be damaged if an inappropriate force is applied thereto. It would, therefore, be advantageous to provide a connection system which would allow for quick connect and disconnect, which would remain stable in varying environmental conditions, and which would allow for the connector halves to disengage if a sufficient force is applied to one of the halves of the connector.

SUMMARY OF THE INVENTION

One aspect of the invention is directed to an adapter for use with a threaded connector assembly. The adapter has a receptacle body and a locking sleeve. The receptacle body is applied to a first portion of the connector assembly, and the locking sleeve is applied to a second portion of the connector assembly. The locking sleeve can be easily disengaged from the receptacle body to remove the second portion or the connector assembly from the first portion.

Another aspect of the invention is directed to an adapter for use with a threaded connector assembly, the connector assembly having a first portion and a second portion. A receptacle body of the adapter has an opening which is dimensioned to receive the first portion of the connector assembly. The opening engages the first portion of the connector assembly to place the receptacle body in electrical engagement with the first portion of the connector assembly. A locking sleeve of the adapter is mounted on the receptacle body. The locking sleeve has mounting projections resiliently mounted thereto, allowing the locking sleeve to cooperate with the second portion of the connector assembly to properly seat the second portion in the locking sleeve. The resiliency of the mounting projections causes the mounting projections to exert sufficient force on the second portion to insure that a positive physical and electrical connection is provided between the locking sleeve and the second portion. The locking sleeve of the adapter can be easily engaged and disengaged from the second portion of the connector assembly. This allows for the threaded connector assembly to be converted to a break-away style connector assembly, such that a force applied or translated to the first portion or the second portion of the connector assembly causes the adapter to disengage the second portion, allowing the second portion to be separated from the adapter and the first portion attached thereto without damaging the adapter, the first portion or the second portion.

Another aspect of the invention is directed to an adapter for use with a connector assembly. The adapter allows the connector assembly to be converted to a break-away style connector assembly. A receptacle body of the adapter has an opening which is dimensioned to receive a first portion of the connector assembly. The opening engages the first portion of the connector assembly to place the receptacle body in electrical engagement with the first portion of the connector assembly. A locking sleeve of the adapter is mounted on the receptacle body. The locking sleeve has mounting projections resiliently mounted thereto. The mounting projections are resiliently deformed, causing the mounting projections to exert sufficient force on a second portion of the connector assembly to insure that a positive physical and electrical connection is provided between the locking sleeve and the second portion. A contact assembly is provided in the adapter. The contact assembly has an inner contact, an outer contact and an insulator positioned between the inner contact and the outer contact. The contact assembly is configured to provide an electrical connection between a male contact of the first portion and a female contact of the second portion. The locking sleeve of the adapter can be easily engaged and disengaged from the second portion of the connector assembly, such that a force applied or translated to the first portion or the second portion of the connector assembly causes the adapter to disengage the second portion, allowing the second portion to be separated from the adapter and the first portion attached thereto without damaging the adapter, the first portion or the second portion.

Another object of the invention is directed to a coaxial adapter for use with a coaxial connector assembly, the coaxial connector assembly having a first portion and a second portion. The coaxial adapter has a receptacle body, a locking sleeve and a contact assembly. The locking sleeve of the coaxial adapter can be easily engaged and disengaged from the second portion of the coaxial connector assembly, such that a force applied or translated to the first portion or the second portion of the coaxial connector assembly causes the coaxial adapter to disengage the second portion. This allows the second portion to be separated from the coaxial adapter and the first portion attached thereto without damaging the coaxial adapter, the first portion or the second portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 2:
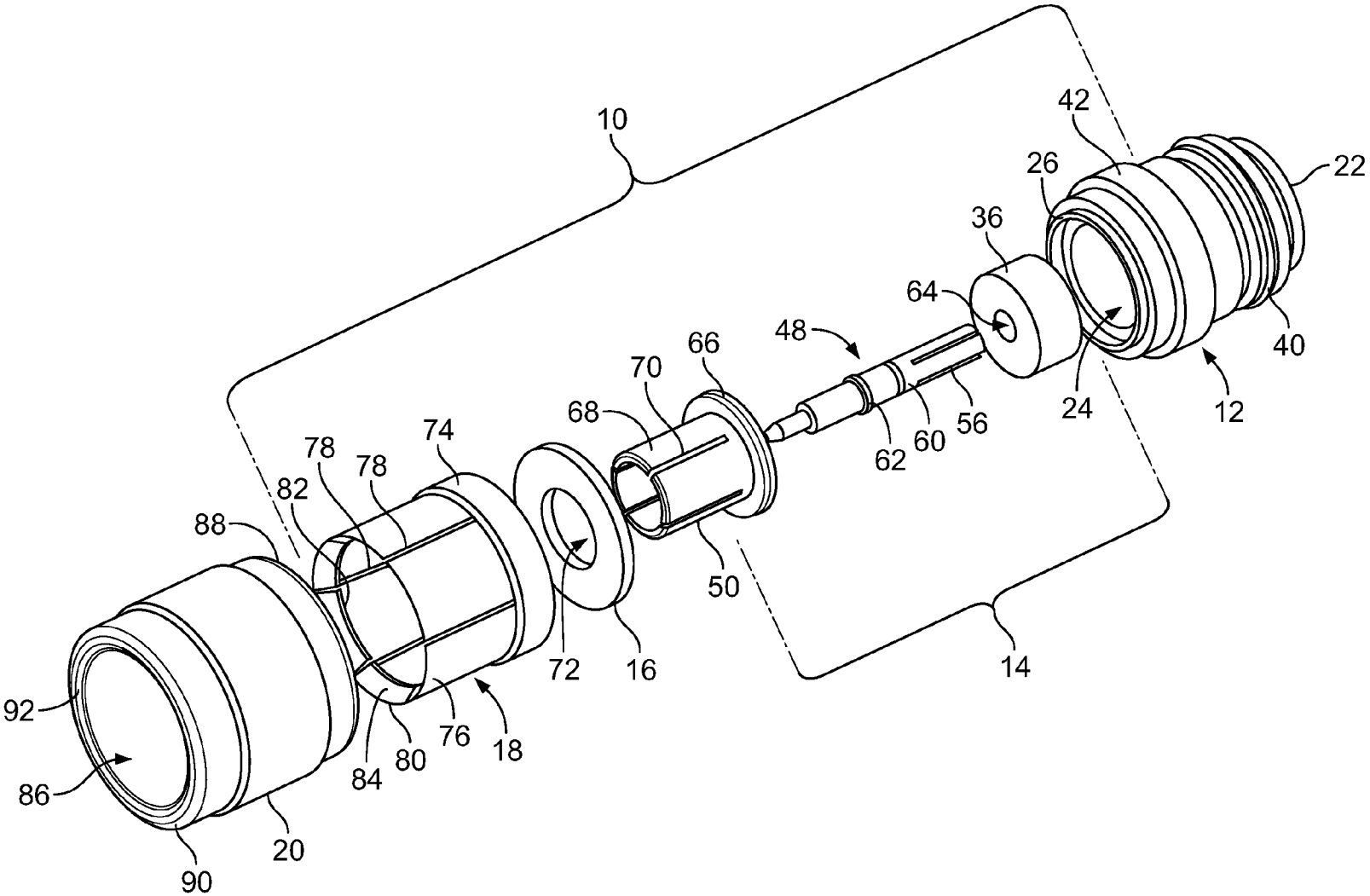
FIG. 2 is an exploded view of the adapter of FIG. 1.
Figure 3:
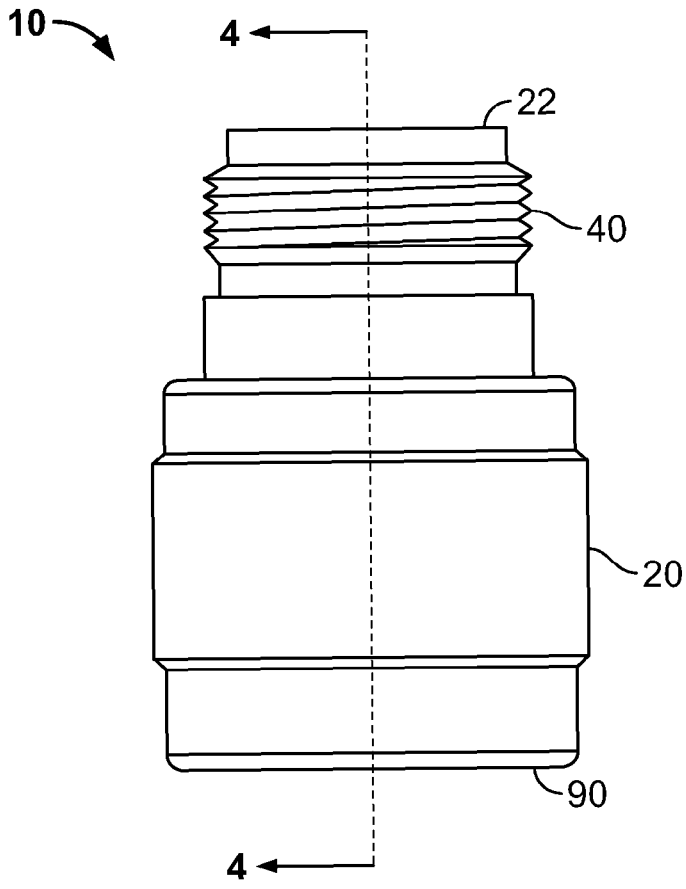
FIG. 3 is a side view of the assembled adapter.
Figure 4:
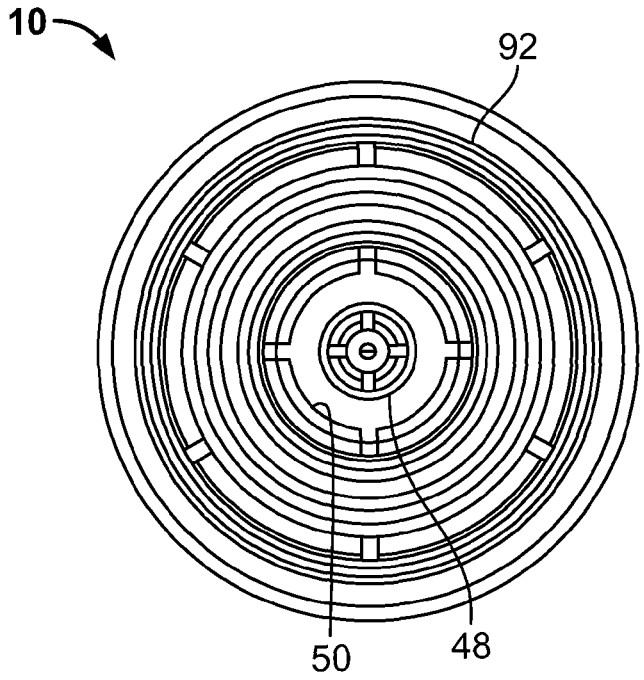
FIG. 4 is a front view of the assembled adapter.

An adapter 10 for use with an N-series coax connector 100, 200 (FIGS. 5 and 6) is disclosed. As best shown in FIG. 2, the adapter 10 has a receptacle body 12, a coaxial contact assembly 14, a gasket 16, a locking sleeve 18 and a shell 20. In general, the N-series coax connector to which the adapter 10 is mated is an N-series coax connector known in the art with a known male portion 100 and a known female portion 200. When mated together, the male portion 100 is threaded to the female portion 200, thereby securing the male portion to the female portion. As the N-series coax connectors are known connectors, such connectors are incorporated herein by reference and a further description of the N-series coax connectors will not be provided.

The receptacle body 12 of the adapter 10 is made from metal or other electrically conductive material which has the strength characteristics required. The receptacle body 12 has a generally cylindrical configuration. As best viewed in FIG. 1, a back surface 22 of the receptacle body 12 has an opening 24 which is dimensioned to receive a portion of the male portion of the N-series coax connector. The opening 24 extends from the back surface 22 of the receptacle body 12 to the front surface 26 (FIG. 2). In the embodiment shown, the opening 24 has sections of different diameters. Proximate the back surface 22, the opening 24 has a first section 28 that is dimensioned to receive a shielding portion of a male contact of the male portion therein. The diameter of the first section 28 is configured to allow the surface surrounding the circumference of the first section 28 to be in electrical engagement with the shielding portion of the male contact, thereby allowing the shielding of the shielding portion of the male contact to be extended through the receptacle body.

A second section 30 of the opening 24 has a smaller diameter than the first section 28. The diameter of the second section 30 approximates the diameter of the shielding portion of the male contact. The transition between the first section 28 and the second section 30 also provides a shoulder 32 on which the shielding portion of the male contact will abut to provide a positive positioning of the male contact relative to the receptacle body 12.

A third section 34 of the opening 24 has a larger diameter than the second section 30. The diameter of the third section 34 is dimensioned to receive an insulator 36 of the contact assembly 14 therein. The transition between the second section 30 and the third section 34 provides a shoulder 38 which helps to maintain an insulator 36 in position.

The receptacle body 12 has threads 40 positioned about the circumference of an outer surface proximate the back surface 22. The threads 40 of the receptacle body 12 are configured to cooperate with the threads of the male portion of the coax connector, as will be more fully described below. The threads 40 are positioned between the front surface 26 and the back surface 22 of the receptacle body 12.

A shell mounting ring 42 is provided on the receptacle body 12 between the threads 40 and the front surface 26. The shell mounting ring 42 projects from the outside surface of the receptacle body 12 a further distance than the threads 40, thereby allowing the shell 20 mounted thereon to freely slide in a direction parallel to the longitudinal axis of the receptacle body 12, as will be more fully described. A locking sleeve-receiving recess 44 and an outer contact-receiving recess 46 are provided proximate the front surface 26 of the receptacle body 12.

Figure 1:
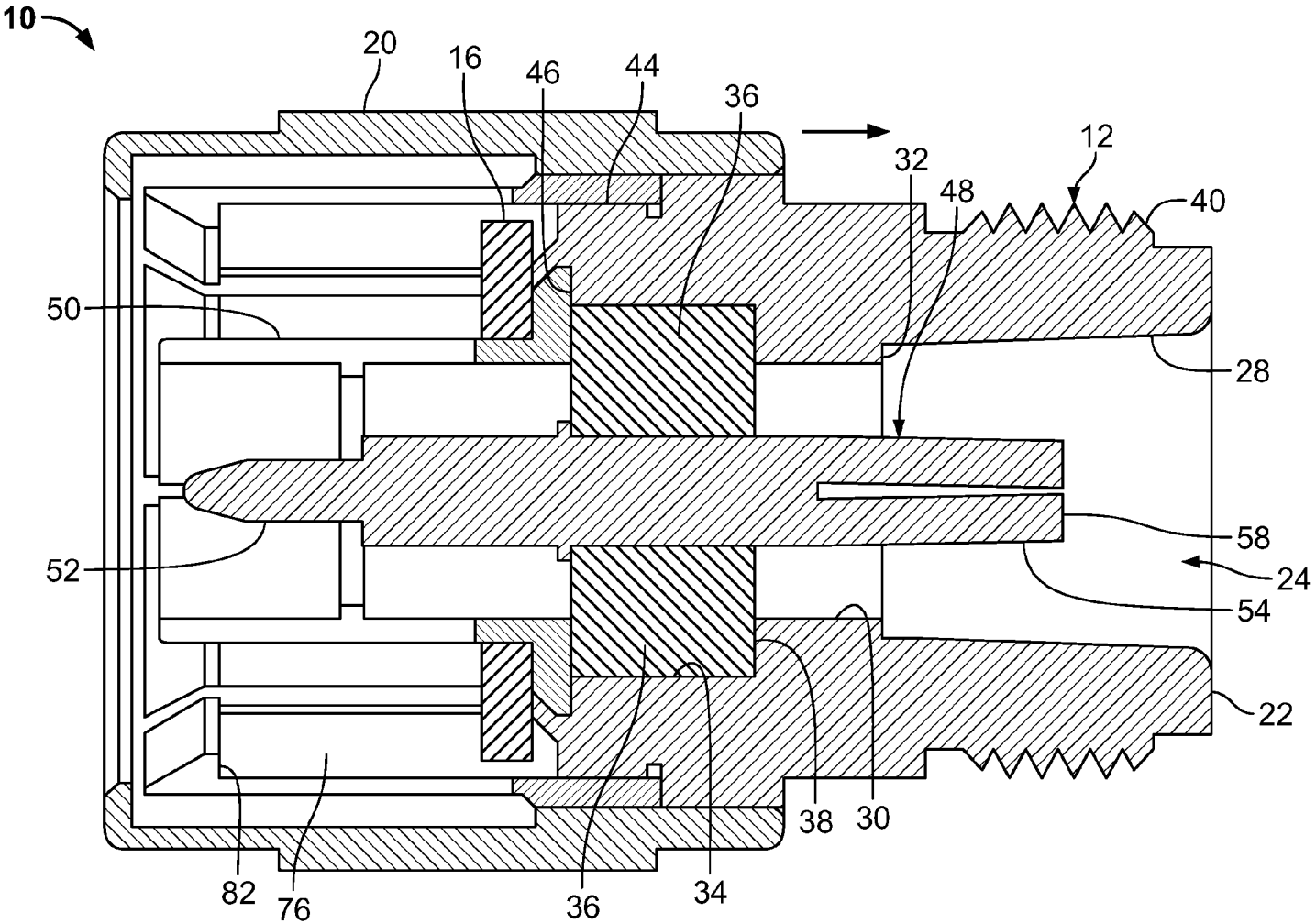
FIG. 1 is a cut-away side view of an adapter for use with a coaxial connector combination in accordance with an illustrated embodiment of the invention.

The contact assembly 14 is of a coaxial construction and has an inner contact 48, an outer contact 50 and an insulator 36. As shown in FIGS. 1 and 2, the inner contact 48 has a front portion 52 which is configured to be essentially the same as the male contact into which the adapter is inserted. A rear portion 54 of the inner contact 48 has slits 56 extending from a back surface 58 toward the front portion 52. The slits 56 define individual resilient legs 60. The resilient legs 60 are provided to deflect away from the longitudinal axis of the inner contact 48 when the inner contact 48 is inserted over the male contact of the male portion of the connector. This allows the resilient legs 60 of the rear portion 54 of the inner contact 48 to exert sufficient force on the male contact to insure that a positive electrical connection is provided between the inner contact 48 and the male contact. A mounting shoulder 62 is provided on the inner contact 48 between the front portion 52 and the rear portion 54. The mounting shoulder 62 cooperates with the insulator 36 to properly position the insulator 36.

The insulator 36 has a generally circular cross-section. The insulator 36 has an opening 64 extending through the longitudinal axis thereof. The opening 64 is dimensioned to receive the inner contact 48 therein. As best shown in FIG. 1, when the insulator 36 is inserted into the receptacle body 12, the insulator 36 is positioned and maintained in the third section 34 of the opening 24.

The outer contact 50 of the contact assembly 14 has a mounting ring 66 with resilient contact arms 68 extending therefrom. The contact arms 68 are separated by slits or openings 70. As viewed in FIG. 1, when assembled, the mounting ring 66 is positioned in engagement with the insulator 36 and is maintained in position relative to the receptacle body 12 in the outer contact-receiving recess 46. The resilient contact arms 68 are provided to deflect from the longitudinal axis of the outer contact 50 when the outer contact 50 is inserted on the female contact of the female portion of the connector. This allows the resilient contact arms 68 of the outer contact 50 to exert sufficient force on the female contact to insure that a positive electrical connection is provided between the outer contact 50 and the female contact.

Referring to FIG. 2, the gasket or washer 16 having a generally circular cross-section is provided. The gasket 16 has a center opening 72 which is dimensioned to be inserted over the resilient contact arms 68 of the outer contact 50. As shown in FIG. 1, the gasket 16 is inserted into the receptacle body 12 through the front surface 26 and is positioned proximate the mounting ring 66 of the outer contact 50.

The locking sleeve 18 has a mounting collar 74 and resilient mounting legs 76 which extend therefrom. The resilient mounting legs 76 are separated by slits 78 which extend from a first end 80 of the locking sleeve 18 toward the mounting collar 74. As is shown in FIGS. 1 and 2, the mounting legs 76 have shoulders 82 proximate the free ends thereof. The shoulders 82 extend inward from the mounting legs 76 to form mounting projections. Tapered surfaces 84 are provided proximate the shoulders or mounting projections 82. As shown in FIG. 2, the mounting collar 74 is positioned and maintained in the locking sleeve-receiving recess 44 when the locking sleeve 18 is assembled to the receptacle body 12. The locking sleeve 18 may be made from metal or other electrically conductive material which has the strength characteristics required. The amount of shielding provided by the locking sleeve 18 is dependent upon the configuration of the mounting legs 76. In the embodiment shown, the mounting legs 76 extend about essentially the entire perimeter of the adapter to provide substantial shielding. However, if the openings or slits 78 between the mounting legs 76 were larger and the surface area of the mounting legs 76 smaller, the shielding properties of the locking sleeve 18 would be reduced.

As shown in FIGS. 1 and 2, the shell 20 has a generally cylindrical configuration. The shell 20 is made from metal or other electrically conductive material which has the strength characteristics required. The diameter of an inner opening 86 proximate a back wall 88 of the shell 20 is dimensioned such that the shell 20 may be inserted onto the receptacle body 12 over the shell mounting ring 42. This allows the shell 20 to be moved in a direction parallel to the longitudinal axis of the receptacle body 12, as is indicated by the arrow of FIG. 1. The inner opening 86 has a larger diameter proximate a front wall 90 of the shell, as best shown in FIG. 1. This allows the resilient mounting legs 76 of the locking sleeve 18 to be resiliently deflected away from the longitudinal axis of the receptacle body 12, as will be more fully discussed. While the space provided between the resilient mounting legs 76 and the shell 20 allows the movement of the resilient mounting legs 76, the positioning of the shell 20 prevents the mounting legs 76 from moving too far and taking a permanent set. A lead-in surface 92 is provided at the front end of the shell 20. The lead-in surface 92 guides the female portion of the connector into the adapter 10 when the adapter 10 is inserted onto the female portion.

Figure 5:
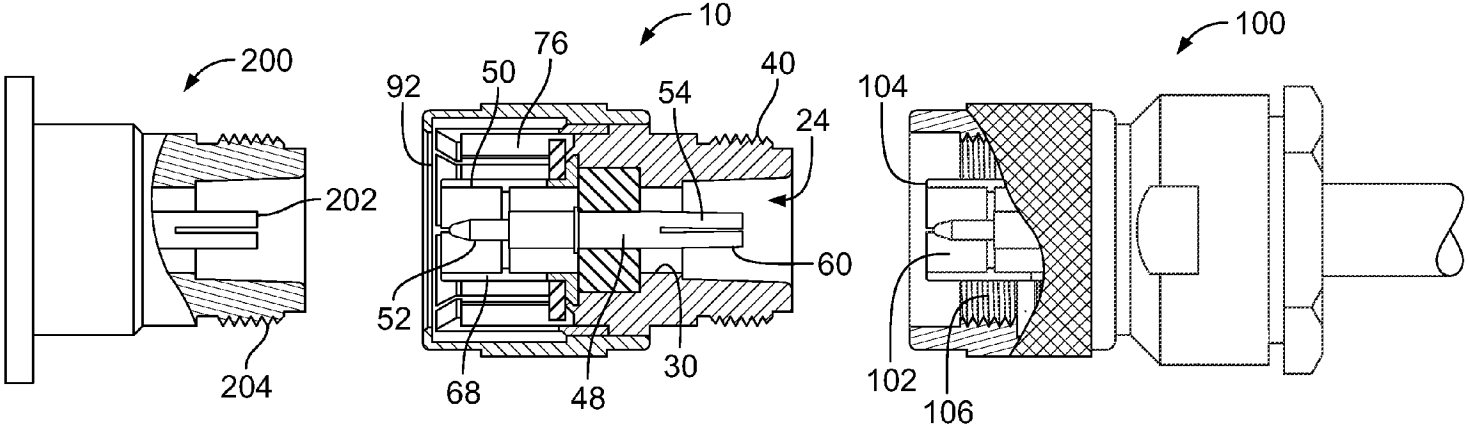
FIG. 5 is a partial cross-sectional view of a male portion of a coax connector, the adapter and a female portion of the coax connector prior to assembly.
Figure 6:
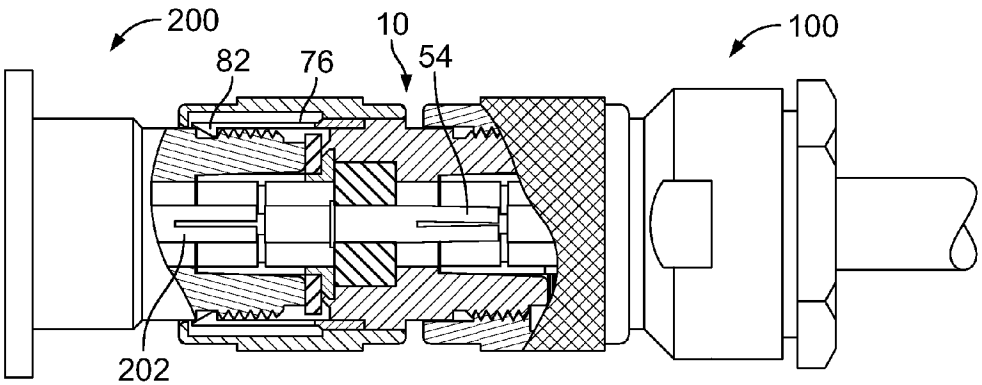
FIG. 6 is a partial cross-sectional view of the male portion of a coax connector, the adapter and the female portion of the coax connector of FIG. 5 in the assembled position.

Referring to FIGS. 5 and 6, with the adapter 10 properly assembled, the adapter 10 is inserted onto the male portion 100 and the female portion 200 of the connector. As the adapter 10 is moved into engagement with the male portion 100, the rear portion 54 of the inner contact 48 is moved into engagement with the male contact 102 of the male portion 100. This causes the resilient legs 60 of the rear portion 54 of the inner contact 48 to be resiliently deformed outward, causing the resilient legs 60 to exert sufficient force on the male contact 102 to insure that a positive electrical connection is provided between the inner contact 48 and the male contact 102. As this occurs, the second section 30 of the receptacle body opening 24 engages a shielding portion 104 of the male portion 100 to provide a physical and electrical engagement therebetween. The threads 40 of the receptacle body 12 are then threaded onto the oppositely facing threads 106 of the male portion 100 of the connector.

As the adapter 10 is moved into engagement with the female portion 200, the resilient contact arms 68 of the outer contact 50 are moved into engagement with the female contact 202 of the female portion 200. This causes the resilient contact arms 68 of the outer contact 50 to be resiliently deformed, causing the resilient contact arms 68 to exert sufficient force on the female contact 202 to insure that a positive electrical connection is provided between the outer contact 50 and the female contact 202. As this occurs, the front portion 52 of the inner contact 48 is inserted into an opening in the female contact 202 of the female portion 200 to provide a physical and electrical engagement therebetween. Threads 204 positioned about an outward-facing cylindrical member of the female portion 200 of the connector are inserted through the lead-in surface 92 of the shell 20 and into the locking sleeve 18. The locking sleeve 18 is dimensioned to allow the threaded portion 204 of the female portion 200 to be inserted between the resilient mounting legs 76. The tapered surfaces 84 of the resilient mounting legs 76 facilitate the proper insertion of the threaded portion 204 of the female portion 200.

As the female portion 200 and the adapter 10 are moved into engagement, the resilient mounting legs 76 of the locking sleeve 18 are moved into engagement with the threaded portion 204 of the female portion 200 of the connector. This causes the resilient mounting legs 76 to be resiliently deformed outward as mounting projections pass over ridges of the threads 204. This continues until the female portion 200 is properly seated in the adapter 10. In this position, the shoulders or mounting projections 82 are positioned in a groove between the ridges of the threads 204. In this position, the resilient mounting legs 76 are deformed slightly, which causes the mounting projections 82 to exert sufficient force on the threads 204 of the female portion 200 to insure that a positive physical connection is provided between the locking sleeve 18 and the female portion 200.

With the mounting projections 82 properly positioned, the mounting shoulders 82 cooperate with the threads 204 of the female portion 200 to prevent the inadvertent removal of the female portion 200 from the adapter 10. However, because of the resilient nature of the resilient contact legs 76, a large force applied or translated to the female portion 200 or the male portion 100 can cause the threads 204 of the female portion 200 to force the resilient contact legs 76 outward. This causes the mounting projections 82 to be moved out of the grooves, thereby allowing the female portion 200 to be separated from the adapter 10 and the male portion 100 attached thereto.

While the adapter 10 shown allows the female portion 200 to break away from the adapter 10 and the male portion 100 under extreme or defined circumstances, an alternate embodiment of the adapter (not shown) also permits the female portion to be quickly disconnected from the adapter and male portion as desired. In the alternate embodiment, a slidable shell is slidably mounted on the receptacle body. When the slidable shell is in a position similar to that shown in FIG. 1, the slidable shell locks the female portion in position and the adapter operates as break-away adapter as described above. However, sliding the slidable shell to the right (as viewed in FIG. 1) causes the slidable shell to be moved past the free ends of the resilient mounting legs, thereby allowing the resilient mounting legs to move more freely away from the threads of the female portion, conveniently releasing the female portion from the adapter and the male portion.

One advantage of the invention is that it allows the female and male portions 200, 100 to turn independently of each other. As the shell 20 and locking sleeve 18 are mounted to the receptacle body 12 in such a manner as to permit the rotation of the shell 20 and the locking sleeve 18 relative to the receptacle body 12, twisting or turning forces applied to either of the male or female portion 100, 200 will not cause the mating portion to be affected. Consequently, the reliability of the connection between the male and female portions of the connector is enhanced by the use of the adapter.

The adapter 10 of this invention allows for conventional threaded connectors, such as N-series connectors, to be converted to break-away style connectors. This allows the connectors to be used in environments in which destructive forces may be present. As the adapter allows for the portions to break away from each other, destructive force will not be translated through the connector to the cable attached thereto; thereby reducing the chance that the components attached to the cables will be damaged.

The adapter 10 also allows the user to quickly and easily connect and disconnect connectors. By using the adapter, threaded connectors are easily converted to quick-connect and -disconnect connectors. This can be advantageous in environments in which space and access to the connector are limited.

While the adapter 10 may be used in a number of different environments, the adapter may generally be used for aligning and connecting rf conductors. Further, for purposes of illustration but not limitation, the adapter has generally been described in the context of an N-series connector. However, other applications will be readily apparent to those of skill in the art.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An adapter for use with a threaded connector assembly, the connector assembly having a first portion and a second portion, the adapter comprising:

a receptacle body having an opening which is dimensioned to receive the first portion of the connector assembly, the opening engaging the first portion of the connector assembly to place the receptacle body in electrical engagement with the first portion of the connector assembly;

a locking sleeve mounted on the receptacle body, the locking sleeve having mounting projections resiliently mounted thereto, the locking sleeve cooperating with the second portion of the connector assembly to properly seat the second portion in the locking sleeve, whereby the mounting projections are resiliently deformed causing the mounting projections to exert sufficient force on the second portion to insure that a positive physical and electrical connection is provided between the locking sleeve and the second portion;

whereby the locking sleeve of the adapter can be easily engaged and disengaged from the second portion of the connector assembly, allowing for the threaded connector assembly to be converted to a break-away style connector assembly, wherein a force applied or translated to the first portion or the second portion of the connector assembly causes the adapter to disengage the second portion, allowing the second portion to be separated from the adapter and the first portion attached thereto without damaging the adapter, the first portion or the second portion.

2. The adapter as recited in claim 1, wherein the receptacle body is made from an electrically conductive material and opening of the receptacle body is dimensioned to receive a shielding portion of the first portion of the connector assembly.

3. The adapter as recited in claim 1, wherein a shell mounting ring is provided on the receptacle body, the shell mounting ring projecting from an outside surface of the receptacle body, thereby allowing a shell mounted thereon to freely slide in a direction parallel to the longitudinal axis of the receptacle body.

4. The adapter as recited in claim 1, wherein the receptacle body has an inner contact, an outer contact and an insulator positioned between the inner contact and the outer contact.

5. The adapter as recited in claim 4, wherein the inner contact has a front portion and a rear portion, the rear portion of the inner contact having slits extending from a back surface toward the front portion defining individual resilient legs, the resilient legs being configured to deflect away from the longitudinal axis of the inner contact when the inner contact is inserted over a male contact of the first portion of the connector assembly, whereby the resilient legs exert sufficient force on the male contact to insure that a positive electrical connection is provided between the inner contact and the male contact.

6. The adapter as recited in claim 4, wherein the outer contact has a mounting ring with resilient contact arms extending therefrom, the contact arms being separated by openings, the resilient contact arms being configured to deflect from the longitudinal axis of the outer contact when the outer contact is inserted on a female contact of the second portion of the connector assembly, whereby the resilient contact arms exert sufficient force on the female contact to insure that a positive electrical connection is provided between the outer contact and the female contact.

7. The adapter as recited in claim 1, wherein the locking sleeve has a mounting collar and resilient mounting legs, the resilient mounting legs being separated by openings which extend from a first end of the locking sleeve toward the mounting collar, the mounting projections being positioned on the mounting legs proximate the free ends thereof, the mounting collar being positioned and maintained in a locking sleeve-receiving recess of the receptacle body when the locking sleeve is assembled to the receptacle body.

8. The adapter as recited in claim 7, wherein a shell is mounted on the receptacle body and extends over the locking sleeve, the shell being spaced from the resilient mounting legs of the locking sleeve, allowing the resilient mounting legs to be resiliently deflected away from the longitudinal axis of the receptacle body, while preventing the mounting legs from taking a permanent set.

9. An adapter for use with a connector assembly, the connector assembly having a first portion and a second portion, the adapter allowing the connector assembly to be converted to a break-away style connector assembly, the adapter comprising:

a receptacle body having an opening which is dimensioned to receive the first portion of the connector assembly, the opening engaging the first portion of the connector assembly to place the receptacle body in electrical engagement with the first portion of the connector assembly;

a locking sleeve mounted on the receptacle body, the locking sleeve having mounting projections resiliently mounted thereto, the locking sleeve cooperating with the second portion of the connector assembly to properly seat the second portion in the locking sleeve, whereby the mounting projections are resiliently deformed causing the mounting projections to exert sufficient force on the second portion to insure that a positive physical and electrical connection is provided between the locking sleeve and the second portion;

a contact assembly having an inner contact, an outer contact and an insulator positioned between the inner contact and the outer contact, the contact assembly configured to provided an electrical connection between a male contact of the first portion and a female contact of the second portion;

whereby the locking sleeve of the adapter can be easily engaged and disengaged from the second portion of the connector assembly, wherein a force applied or translated to the first portion or the second portion of the connector assembly causes the adapter to disengage the second portion, allowing the second portion to be separated from the adapter and the first portion attached thereto without damaging the adapter, the first portion or the second portion.

10. The adapter as recited in claim 9 wherein the receptacle body is made from an electrically conductive material and opening of the receptacle body is dimensioned to receive a shielding portion of the first portion of the connector assembly.

11. The adapter as recited in claim 9, wherein a shell mounting ring is provided on the receptacle body, the shell mounting ring projecting from an outside surface of the receptacle body, thereby allowing a shell mounted thereon to freely slide in a direction parallel to the longitudinal axis of the receptacle body.

12. The adapter as recited in claim 9, wherein the inner contact has a front portion and a rear portion, the rear portion of the inner contact having slits extending from a back surface toward the front portion defining individual resilient legs, the resilient legs being configured to deflect away from the longitudinal axis of the inner contact when the inner contact is inserted over the male contact of the first portion of the connector assembly, whereby the resilient legs exert sufficient force on the male contact to insure that a positive electrical connection is provided between the inner contact and the male contact.

13. The adapter as recited in claim 12, wherein the outer contact has a mounting ring with resilient contact arms extending therefrom, the contact arms being separated by openings, the resilient contact arms being configured to deflect from the longitudinal axis of the outer contact when the outer contact is inserted on the female contact of the second portion of the connector assembly, whereby the resilient contact arms exert sufficient force on the female contact to insure that a positive electrical connection is provided between the outer contact and the female contact.

14. The adapter as recited in claim 9, wherein the locking sleeve has a mounting collar and resilient mounting legs, the resilient mounting legs being separated by openings which extend from a first end of the locking sleeve toward the mounting collar, the mounting projections being positioned on the mounting legs proximate the free ends thereof, the mounting collar being positioned and maintained in a locking sleeve-receiving recess of the receptacle body when the locking sleeve is assembled to the receptacle body.

15. The adapter as recited in claim 14, wherein a shell is mounted on the receptacle body and extends over the locking sleeve, the shell being spaced from the resilient mounting legs of the locking sleeve allowing the resilient mounting legs to be resiliently deflected away from the longitudinal axis of the receptacle body, while preventing the mounting legs from taking a permanent set.

16. A coaxial adapter for use with a coaxial connector assembly, the coaxial connector assembly having a first portion and a second portion, the coaxial adapter allowing the coaxial connector assembly to be converted to a break-away style coaxial connector assembly, the coaxial adapter comprising:

a receptacle body having an opening which is dimensioned to receive the first portion of the coaxial connector assembly, the opening engaging the first portion of the coaxial connector assembly to place the receptacle body in electrical engagement with the first portion of the coaxial connector assembly;

a locking sleeve mounted on the receptacle body, the locking sleeve having mounting projections resiliently mounted thereto, the locking sleeve cooperating with the second portion of the coaxial connector assembly to properly seat the second portion in the locking sleeve, whereby the mounting projections are resiliently deformed causing the mounting projections to exert sufficient force on the second portion to insure that a positive physical and electrical connection is provided between the locking sleeve and the second portion;

a contact assembly having an inner contact, an outer contact and an insulator positioned between the inner contact and the outer contact, the contact assembly configured to provided an electrical connection between a male contact of the first portion and a female contact of the second portion;

whereby the locking sleeve of the coaxial adapter can be easily engaged and disengaged from the second portion of the coaxial connector assembly, wherein a force applied or translated to the first portion or the second portion of the coaxial connector assembly causes the coaxial adapter to disengage the second portion, allowing the second portion to be separated from the coaxial adapter and the first portion attached thereto without damaging the coaxial adapter, the first portion or the second portion.

17. The coaxial adapter as recited in claim 16, wherein the receptacle body is made from an electrically conductive material and opening of the receptacle body is dimensioned to receive a shielding portion of the first portion of the connector assembly.

18. The coaxial adapter as recited in claim 17, wherein the inner contact has a front portion and a rear portion, the rear portion of the inner contact having slits extending from a back surface toward the front portion defining individual resilient legs, the resilient legs being configured to deflect away from the longitudinal axis of the inner contact when the inner contact is inserted over the male contact of the first portion of the connector assembly, whereby the resilient legs exert sufficient force on the male contact to insure that a positive electrical connection is provided between the inner contact and the male contact.

19. The coaxial adapter as recited in claim 18, wherein the outer contact has a mounting ring with resilient contact arms extending therefrom, the contact arms being separated by openings, the resilient contact arms being configured to deflect from the longitudinal axis of the outer contact when the outer contact is inserted on the female contact of the second portion of the connector assembly, whereby the resilient contact arms exert sufficient force on the female contact to insure that a positive electrical connection is provided between the outer contact and the female contact.

20. The coaxial adapter as recited in claim 19, wherein a shell is mounted on the receptacle body and extends over the locking sleeve, the shell being spaced from the mounting projections of the locking sleeve, allowing the mounting projections to be resiliently deflected away from the longitudinal axis of the receptacle body, while preventing the mounting projections from taking a permanent set.

* * * * *